US010227222B2

(12) United States Patent
Kendall et al.

(10) Patent No.: US 10,227,222 B2
(45) **Date of Patent: *Mar. 12, 2019**

(54) PRECAST CONCRETE PIT

(71) Applicant: Vehicle Service Group, LLC, Madison, IN (US)

(72) Inventors: Larry Kendall, Madison, IN (US); Gerry Lauderbaugh, Madison, IN (US); Chuck Luhn, Madison, IN (US); Jonathan J. Westbrook, Buckner, KY (US); Jonathan Ross, Beaver Dam, KY (US)

(73) Assignee: Vehicle Service Group, LLC, Madison, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/414,361

(22) Filed: Jan. 24, 2017

(65) Prior Publication Data

US 2017/0233230 A1 Aug. 17, 2017

Related U.S. Application Data

(63) Continuation-in-part of application No. 15/225,027, filed on Aug. 1, 2016.

(Continued)

(51) Int. Cl.
*B66F 7/16* (2006.01)
*B66F 7/28* (2006.01)

(Continued)

(52) U.S. Cl.
CPC ..... *B66F 7/28* (2013.01); *B66F 7/16* (2013.01); *E04B 1/043* (2013.01); *E04H 5/06* (2013.01);

(Continued)

(58) Field of Classification Search
CPC .... B66F 7/28; B66F 7/00; B66F 13/00; E04B 1/043
See application file for complete search history.

(56) References Cited

U.S. PATENT DOCUMENTS 1,638,790 A 8/1927 Weaver
1,758,262 A 5/1930 Mahoney (Continued)

FOREIGN PATENT DOCUMENTS

BE 366902 A 11/1930
CH 131433 A 2/1929

(Continued)

OTHER PUBLICATIONS

Celette La Vega brochure (1996), 2 pgs.

(Continued)

*Primary Examiner* — Diem M Tran
(74) *Attorney, Agent, or Firm* — Frost Brown Todd LLC

(57) ABSTRACT

A pit for containing a vehicle lifting apparatus is constructed from a plurality of precast concrete pieces and assembled in a trench. Conduit, plumbing, heating elements, and the like are cast into the pieces to facilitate safe construction/assembly of the pit. A lift apparatus is assembled or positioned in and at least partly attached to the pit. One or more mounting features are cast into and/or attached to the pit wall to help fix the lifting apparatus relative to the pit and/or to help fix the pit relative to a surrounding building.

16 Claims, 12 Drawing Sheets

Related U.S. Application Data

(60) Provisional application No. 62/199,740, filed on Jul. 31, 2015.

(51) Int. Cl.
*E04B 1/04* (2006.01)
*E04H 5/06* (2006.01)
*E04H 6/42* (2006.01)

(52) U.S. Cl.
CPC ..... *B66F 2700/055* (2013.01); *E04H 6/428* (2013.01)

(56) References Cited

U.S. PATENT DOCUMENTS

| | | | | |
|---|---|---|---|---|
| 2,132,343 | A | | 10/1938 | Moss |
| 2,557,465 | A | | 6/1951 | Rauscher, Sr. |
| 2,891,765 | A | | 6/1959 | Pearne |
| 2,942,848 | A | | 6/1960 | Friesen |
| 2,984,072 | A | | 5/1961 | Born |
| 3,038,700 | A | | 6/1962 | Ascherl |
| 3,195,860 | A | | 7/1965 | Gausewitz |
| 3,265,357 | A | | 8/1966 | Schilling |
| 3,289,868 | A | | 12/1966 | Miller |
| 3,340,720 | A | | 9/1967 | Chartier |
| 3,377,924 | A | | 4/1968 | Spencer et al. |
| 3,486,583 | A | | 12/1969 | Wiklund |
| 3,556,480 | A | | 1/1971 | Johansson |
| 3,638,535 | A | | 2/1972 | Ponter |
| 3,689,030 | A | | 9/1972 | Backus |
| 3,757,899 | A | | 9/1973 | Smith |
| 3,835,693 | A | | 9/1974 | Majersky |
| 3,837,435 | A | * | 9/1974 | Pelouch ..... B66F 7/0625 187/211 |
| 3,967,701 | A | | 7/1976 | Hegenbart |
| 3,968,730 | A | | 7/1976 | Lionet |
| 3,991,857 | A | | 11/1976 | Wolk et al. |
| 4,151,737 | A | | 5/1979 | Specktor |
| 4,230,304 | A | | 10/1980 | Tol |
| 4,241,901 | A | | 12/1980 | Shircliffe |
| 4,336,705 | A | | 6/1982 | Specktor |
| 4,398,410 | A | | 8/1983 | McWhorter et al. |
| 4,501,136 | A | | 2/1985 | Celette |
| 4,534,544 | A | | 8/1985 | Heide |
| 4,574,614 | A | | 3/1986 | Field |
| 4,679,489 | A | | 7/1987 | Jasinski et al. |
| 4,706,458 | A | | 11/1987 | Corghi |
| 4,724,930 | A | | 2/1988 | VanLierop |
| 4,763,761 | A | | 8/1988 | McKinsey et al. |
| 4,777,798 | A | | 10/1988 | Jacobson et al. |
| 4,823,589 | A | | 4/1989 | Maxwell, Jr. et al. |
| 4,848,732 | A | | 7/1989 | Rossato |
| 4,901,980 | A | | 2/1990 | Hansen |
| 4,986,107 | A | | 1/1991 | Peyret |
| 5,012,898 | A | | 5/1991 | Tsymberov |
| 5,016,465 | A | | 5/1991 | Papesh |
| 5,024,141 | A | | 6/1991 | Kawada |
| 5,027,639 | A | | 7/1991 | Hinson |
| 5,031,726 | A | | 7/1991 | Wakamiya |
| 5,050,844 | A | | 9/1991 | Hawk |
| 5,065,844 | A | | 11/1991 | Hon |
| 5,096,159 | A | | 3/1992 | Fletcher |
| 5,099,956 | A | | 3/1992 | Curran |
| 5,131,257 | A | | 7/1992 | Mingardi |
| 5,157,228 | A | | 10/1992 | Ackermann et al. |
| 5,186,038 | A | | 2/1993 | Venalainen |
| 5,189,899 | A | | 3/1993 | Hsu |
| 5,190,122 | A | | 3/1993 | Fletcher et al. |
| 5,199,289 | A | | 4/1993 | Hinson |
| 5,199,686 | A | | 4/1993 | Fletcher |
| 5,211,265 | A | | 5/1993 | Gregg |
| 5,239,854 | A | | 8/1993 | Hinson |
| 5,251,013 | A | | 10/1993 | Danielson |
| 5,263,357 | A | | 11/1993 | Dumais |
| D346,255 | S | | 4/1994 | Francis et al. |
| 5,299,658 | A | | 4/1994 | Cox et al. |
| 5,299,904 | A | | 4/1994 | Simon et al. |
| 5,341,575 | A | | 8/1994 | Chisum |
| 5,355,711 | A | | 10/1994 | Chisum |
| 5,596,900 | A | | 1/1997 | Pietrelli |
| 5,640,878 | A | | 6/1997 | Hinson |
| 5,644,946 | A | | 7/1997 | Weschler |
| 5,679,934 | A | | 10/1997 | Juntunen et al. |
| 5,695,173 | A | | 12/1997 | Ochoa et al. |
| 5,724,853 | A | | 3/1998 | Johansson |
| 5,727,655 | A | | 3/1998 | Pitman |
| 5,740,886 | A | | 4/1998 | Fletcher |
| 5,778,608 | A | * | 7/1998 | Elliott, Jr. ..... B65D 88/76 220/565 |
| 5,801,834 | A | | 9/1998 | Danielson |
| 5,829,948 | A | | 11/1998 | Becklund |
| 5,860,491 | A | | 1/1999 | Fletcher |
| 5,918,500 | A | | 7/1999 | Brewer, Jr. |
| 5,929,399 | A | | 7/1999 | Jamieson et al. |
| 5,931,043 | A | | 8/1999 | Liegel et al. |
| 5,967,494 | A | | 10/1999 | Fiorese |
| 6,000,272 | A | | 12/1999 | Hinson |
| 6,050,573 | A | | 4/2000 | Kunz |
| 6,059,263 | A | | 5/2000 | Otema et al. |
| 6,164,415 | A | | 12/2000 | Takeuchi et al. |
| 6,189,432 | B1 | | 2/2001 | Colarelli et al. |
| 6,213,451 | B1 | | 4/2001 | Finkbeiner |
| 6,269,676 | B1 | | 8/2001 | Soyk |
| 6,286,629 | B1 | | 9/2001 | Saunders |
| 6,443,429 | B1 | | 9/2002 | Hawk et al. |
| 6,484,554 | B2 | | 11/2002 | Soyk |
| 6,601,430 | B2 | | 8/2003 | McClellan |
| 6,679,479 | B1 | | 1/2004 | Watkins |
| 6,763,916 | B2 | | 7/2004 | Green et al. |
| 6,918,576 | B2 | | 7/2005 | Finkbeiner |
| 6,974,123 | B2 | | 12/2005 | Latvys |
| 6,983,196 | B2 | | 1/2006 | Green et al. |
| 7,066,448 | B2 | | 6/2006 | Thurm |
| 7,213,686 | B2 | | 5/2007 | Kaufman |
| 7,225,898 | B2 | | 6/2007 | Bourgeois |
| 7,275,713 | B2 | | 10/2007 | Hillsamer et al. |
| 8,052,122 | B2 | | 11/2011 | Rossato et al. |
| 8,286,944 | B2 | | 10/2012 | Rossato et al. |
| 8,496,090 | B2 | | 7/2013 | Berends |
| 8,752,675 | B2 | | 6/2014 | Berends |
| 8,770,549 | B2 | | 7/2014 | Deuring et al. |
| 8,888,070 | B2 | | 11/2014 | Olesen |
| 9,050,223 | B2 | | 6/2015 | Ohta et al. |
| 9,145,284 | B2 | | 9/2015 | Finkbeiner et al. |
| 9,254,990 | B2 | | 2/2016 | Matthews et al. |
| 2003/0075657 | A1 | | 4/2003 | Joubert |
| 2004/0200258 | A1 | | 10/2004 | Hess |
| 2004/0262490 | A1 | | 12/2004 | King |
| 2010/0243973 | A1 | | 9/2010 | Deuring et al. |
| 2011/0309316 | A1 | | 12/2011 | Kim |

FOREIGN PATENT DOCUMENTS

| | | | |
|---|---|---|---|
| DE | 433136 | C | 8/1926 |
| DE | 2008788 | A1 | 10/1971 |
| DE | 2231488 | A1 | 1/1974 |
| DE | 3340883 | A1 | 5/1985 |
| DE | 9115317 | U1 | 3/1992 |
| EP | 0615645 | A1 | 9/1994 |
| FR | 1109336 | A | 1/1956 |
| GB | 783915 | A | 10/1957 |
| GB | 2084541 | A | 4/1982 |
| IT | VR 930014 | U1 | 10/1994 |
| JP | H03166199 | A | 7/1991 |
| JP | H08333093 | A | 12/1996 |
| WO | WO 93/11517 | A1 | 6/1993 |
| WO | WO 1995/011189 | A1 | 4/1995 |
| WO | WO 2007/148960 | A1 | 12/2007 |

OTHER PUBLICATIONS

Chief Automotive Systems Streamliner Productivity brochure (1999), 2 pgs.

(56) References Cited

OTHER PUBLICATIONS

Dymax x-100 (brochure), 3 pgs.
Iyasaka System Car-O-Liner Mini Bench brochure (1997), 8 pgs.
RosAuto Mini Tir Straightening Bench brochure, 3 pgs.
Spanesi Iberica, S.L. Mini Bench brochure (Automechanika 1996), 5 pgs.
U.S. Office Action dated Aug. 5, 2003 for U.S. Appl. No. 10/055,800, 10 pgs.
U.S. Notice of Allowance dated Mar. 19, 2004 for U.S. Appl. No. 10/055,800, 4 pgs.
U.S. Notice of Allowance dated Mar. 30, 2005 for U.S. Appl. No. 10/055,800, 4 pgs.
Before the Patent Trial and Appeal Board, *Mohawk Resources Ltd.*, Petitioner, v. *Vehicle Service Group, LLC*, Patent Owner, Case IPR2014-00464, U.S. Pat. No. 6,983,196 B2, Decision, Institution of Inter Partes Review, Aug. 29, 2014, 20 pgs.
Before the Patent Trial and Appeal Board, *Mohawk Resources Ltd.*, Petitioner, v. *Vehicle Service Group, LLC*, Patent Owner, Case IPR2014-00464, U.S. Pat. No. 6,983,196 B2, Judgment, Termination of the Proceeding, Sep. 12, 2014 3 pgs.
U.S. Office Action dated Apr. 7, 2015 for U.S. Appl. No. 13/290,270, 6 pgs.
U.S. Notice of Allowance dated Nov. 10, 2015 for U.S. Appl. No. 13/290,270, 5pgs.
International Search Report and Written Opinion dated Jun. 28, 2010 for Application No. PCT/US2010/032647, 7 pgs.

* cited by examiner

PRECAST CONCRETE PIT

REFERENCE TO RELATED APPLICATIONS

This application claims priority to and is a non-provisional of U.S. Provisional Patent Application No. 62/199,740, filed Jul. 31, 2015, with title "Precast Concrete Pit," and is a continuation-in-part of U.S. patent application Ser. No. 15/225,027, filed Aug. 1, 2016, with title "Precast Concrete Pit."

BACKGROUND

A vehicle lift is a device operable to lift a vehicle such as a car, truck, bus, etc. Some vehicle lifts operate by positioning two runways at or near a shop floor level. The vehicle may be then driven or rolled onto the runways, allowing the runways to support the vehicle. The underside of each runway may be attached to a plurality of powered or manually actuated lifting assemblies. The lifting assemblies may be actuated to raise the runways and the vehicle to a desired height. Afterward, the vehicle may then be lowered once the user has completed his or her task requiring the vehicle lift. In some cases, the lifting assemblies may comprise a single elongated member which may rotate relative to the floor to pivot the runways upwardly. Because of the rotational motion of the lifting assemblies, some horizontal motion of the runways may be encountered. In other cases, the lifting assemblies may comprise a plurality of linkages which pivot relative to one another to cause the runways to rise upwardly, similar to a pair of scissors.

Examples of vehicle lift devices and related concepts are disclosed in U.S. Pat. No. 6,983,196, entitled "Electronically Controlled Vehicle Lift and Vehicle Services System," issued Jan. 3, 2006, the disclosure of which is incorporated by reference herein; U.S. Pat. No. 6,763,916, entitled "Method and Apparatus for Synchronizing a Vehicle Lift," issued Jul. 20, 2004, the disclosure of which is incorporated by reference herein; U.S. Pat. No. 6,601,430, entitled "Jack with Elevatable Platform," issued Aug. 5, 2003, the disclosure of which is incorporated by reference herein; U.S. Pat. No. 6,484,554, entitled "Portable Lift and Straightening Platform," issued Nov. 26, 2002, the disclosure of which is incorporated by reference herein; U.S. Pat. No. 6,269,676, entitled "Portable Lift and Straightening Platform," issued Aug. 7, 2001, the disclosure of which is incorporated by reference herein; U.S. Pat. No. 6,059,263, entitled "Automotive Alignment Lift," issued May 9, 2000, the disclosure of which is incorporated by reference herein; U.S. Pat. No. 5,199,686, entitled "Non-Continuous Base Ground Level Automotive Lift System," issued Apr. 6, 1993, the disclosure of which is incorporated by reference herein; U.S. Pat. No. 5,190,122, entitled "Safety Interlock System," issued Mar. 2, 1993, the disclosure of which is incorporated by reference herein; U.S. Pat. No. 5,096,159, entitled "Automotive Lift System," issued Mar. 17, 1992, the disclosure of which is incorporated by reference herein; and U.S. Pub. No. 2012/0048653, entitled "Multi-Link Automotive Alignment Lift," published Mar. 1, 2012, the disclosure of which is incorporated by reference herein.

Vehicle lifts require substantial structural and/or mechanical support for the lift device itself and the weight of the vehicle being lifted. Some lift systems have that support above ground, while others have it below ground. With in-ground systems, a pit is typically constructed to contain the support.

In some in-ground systems, the lift support frame assemblies are attached to freshly poured concrete pit wall sections that can take multiple concrete pours to construct. Some require extensive framing for the concrete walls, and they may involve assembling block walls and filling voids with concrete. With all of these methods, the ground in which the pit is constructed is typically dug out substantially wider than the concrete structure so that personnel can safely position themselves in the trench to build the structure. The extra space must then be backfilled, and both the additional removal of earth and the backfilling process can weaken the area around the pit.

While a variety of concrete pits have been made and used, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawing, in which like reference numerals identify the same elements and in which.

Figure 1:
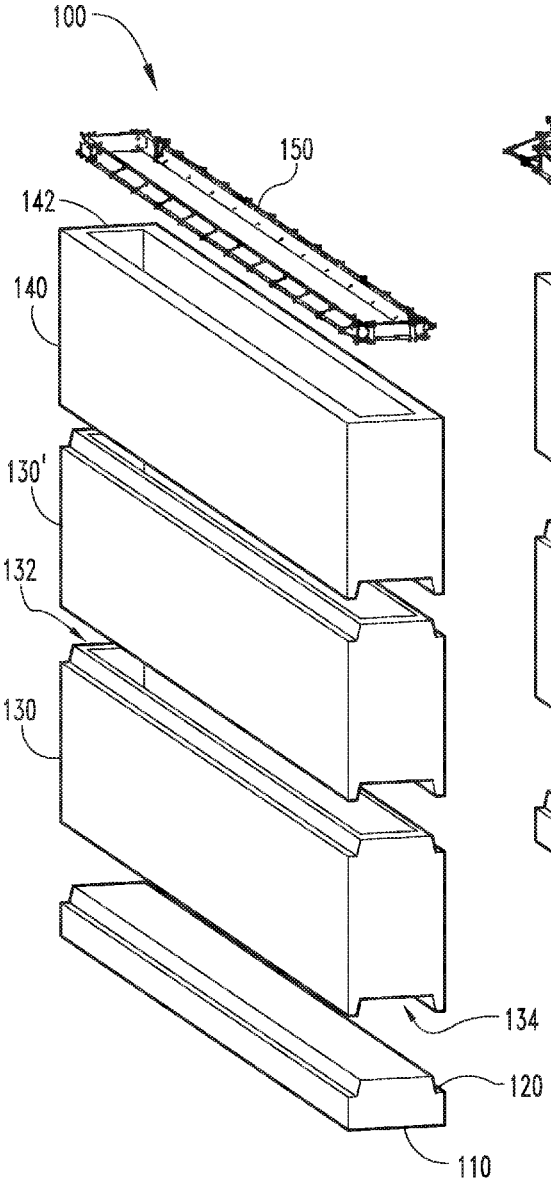
FIG. 1 is a perspective, exploded view of a first modular lift pit structure that may house a vehicle lift assembly.

The drawings are not intended to be limiting in any way, and it is contemplated that various embodiments of the invention may be carried out in a variety of other ways, including those not necessarily depicted in the drawings. The accompanying drawings, incorporated in and forming a part of the specification, illustrates several aspects of the present invention, and together with the description serves to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects and implementations, all without departing from the invention. Accordingly, the drawing and description should be regarded as illustrative and not restrictive in nature.

In the illustrated embodiments, an in-ground jack frame assembly is placed atop precast cured concrete pit sections. The benefits of this approach include that there is no need to put a person in the trench, so the required excavation, slab cutting, benching, etc. is substantially reduced, yielding a great deal of cost and time savings. Various implementations of the system and methods described herein reduce construction waste, minimize site disturbance by the installation, and are better adapted for LEED buildings.

Figure 2:
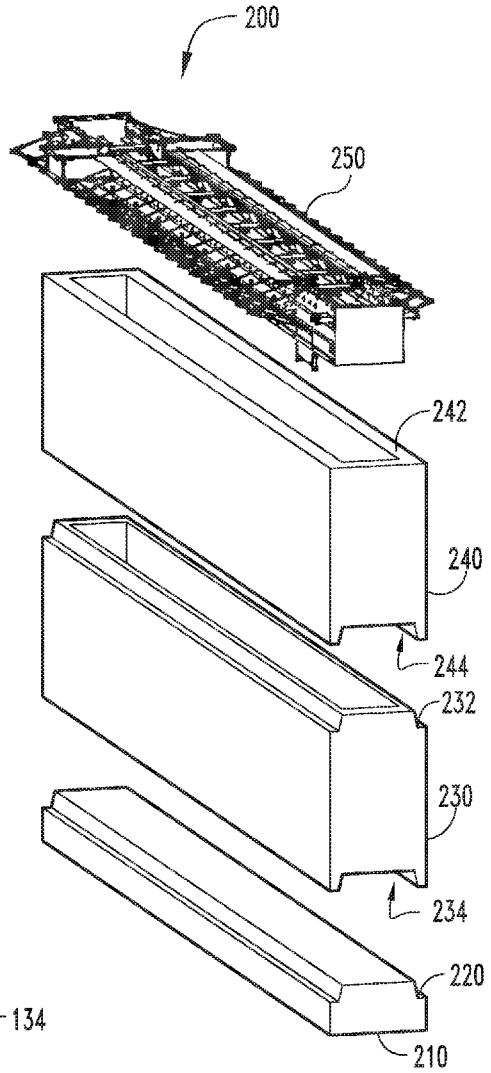
FIG. 2 is a perspective, exploded view of a second modular lift pit structure that may house a vehicle lift assembly.

FIGS. 1-2 show two sample implementations of the precast concrete pit of the present disclosure. Considering pit structure 100, a site is prepared by excavating ground sufficient to contain the pit or vault needed for the lift base and support structures. Precast slab 110, which will form the base of pit structure 100, has a top surface that slopes toward the center, where in some embodiments a small sump pit is cut out and/or a knock-out is created for one or more floor drains, such as those produced by ZURN Industries, LLC (of Erie, Pa.) or BLUCHER Metal A/S (of Vildbjerg, Denmark). A groove 120 around the outer edges of slab 110 facilitates self-centering and sealing of the walls 130 with the slab 110 along those corners.

Precast wall piece 130 is a box with an open top 132 and open bottom 134. The top and bottom edges of wall piece 130 have complementary components with the edges of precast slab 110 and the wall piece 130' that will sit on top of it to form suitable interfaces, preferably waterproof, tongue-and-groove connections. The height of each wall piece 130, 130', and upper precast wall piece 140 is selected so that the top of upper precast wall piece 140 reaches floor level, which might be any height above precast slab 110 and might be reached by combination of any number of (one or more) precast wall pieces 130, 130', 140. In this illustrated embodiment, upper precast wall piece 140 has top edge 142 that is preferably adapted to interface with jack frame 150 as will occur to those skilled in the art.

FIG. 2 shows alternative pit structure 200. Alternative pit structure 200 is built on precast base 210 with connection features (such as grooves) 220 on our around its top surface. As will be described in greater detail below, precast wall piece 230 has mating features 234 along its bottom edge to facilitate connection with precast base 210, and further has features 232 along its top edge to facilitate connection with upper precast wall piece 240. Similar to precast wall piece 230, upper precast wall piece 240 also has mating features 244 along its bottom edge to facilitate connection with features 232 of precast wall piece 230. Additionally, upper precast wall piece 240 has top edge 242 to connect with one or more components of the lift system and/or the floor of the surrounding building, represented in the figure by mechanical assembly 250.

Figure 3A:
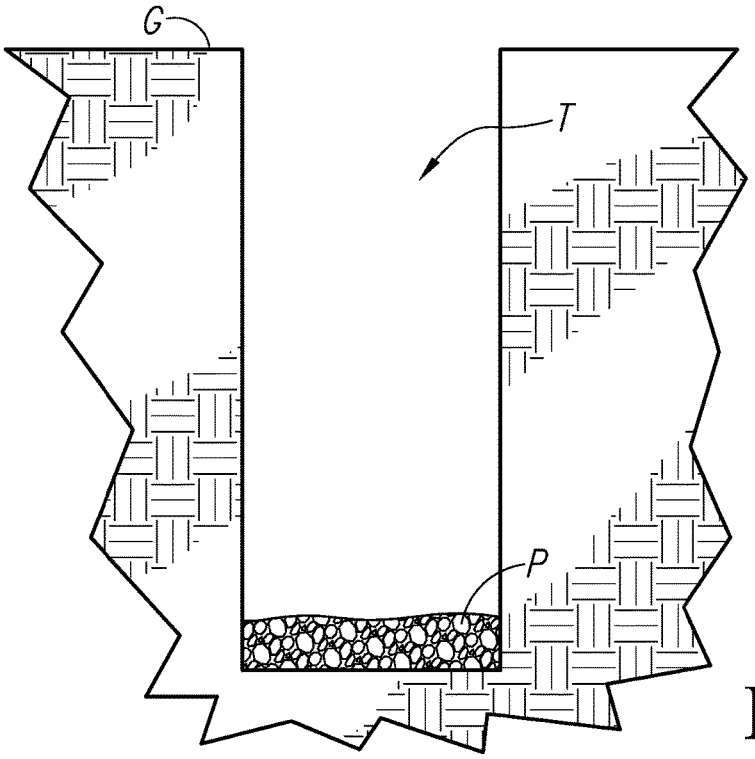
FIG. 3A is a front elevational view of a trench sized to house the second modular lift pit structure of FIG. 2, wherein the bottom of the trench is filled with pea gravel.

FIGS. 3A-3E show an exemplary process of installing pit structure 200 within ground G. It should be understood that pit structure 100 or other pit structures described herein may be installed in similar manner as would be apparent to one having ordinary skill in the art in view of the teachings herein. As shown in FIG. 3A, when pit structure 200 is installed, the site is prepared by excavating a trench T sufficient to contain the pit structure 200 with a modest margin to allow for placement. In some embodiments, trench T will be approximately 4 feet wide and 34 feet long. Of course, soil content, ground conditions, water table, and other factors may require different excavation techniques, sizes, and processes as will occur to those skilled in the art in view of this disclosure. The base of trench T is preferably tamped, such as with the bucket of the excavator, so that the base is adequately compacted.

Figure 3B:
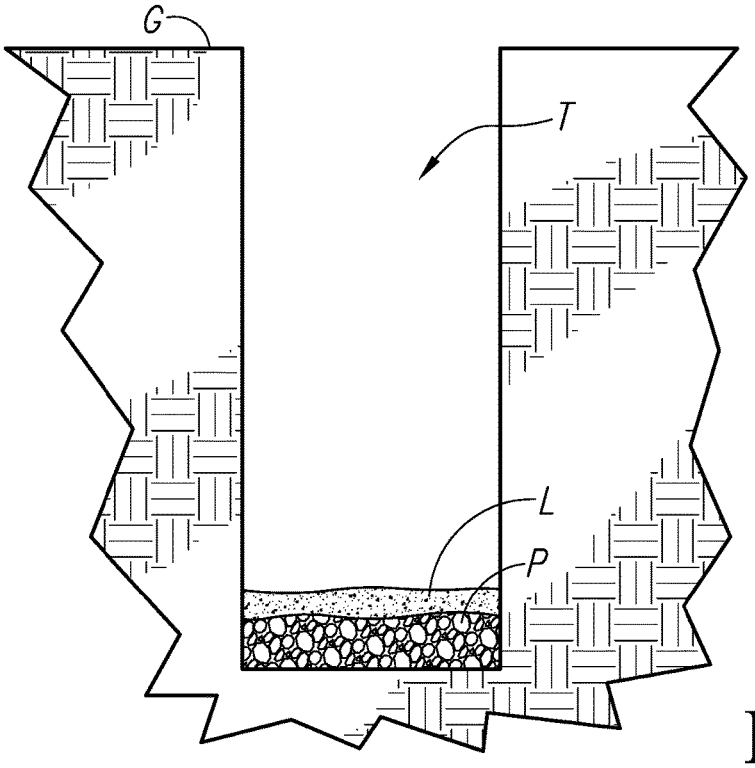
FIG. 3B is a front elevational view of the trench of FIG. 3A, with a layer of "lean" concrete poured on-top of the pea gravel.
Figure 3C:
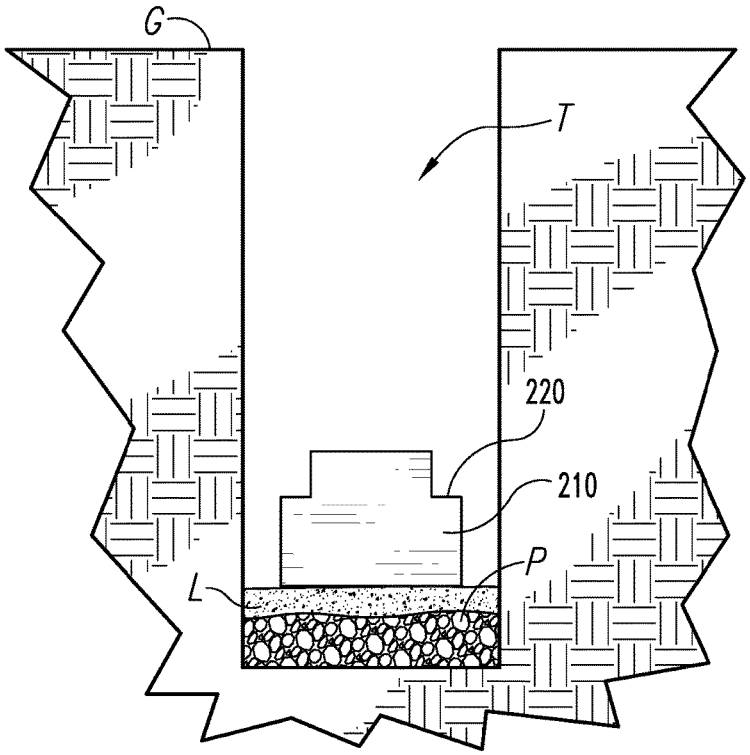
FIG. 3C is a front elevation view of the trench of FIG. 3A, with a precast base of the second modular lift pit structure of FIG. 2 placed on-top of the "lean" concrete.
Figure 3D:
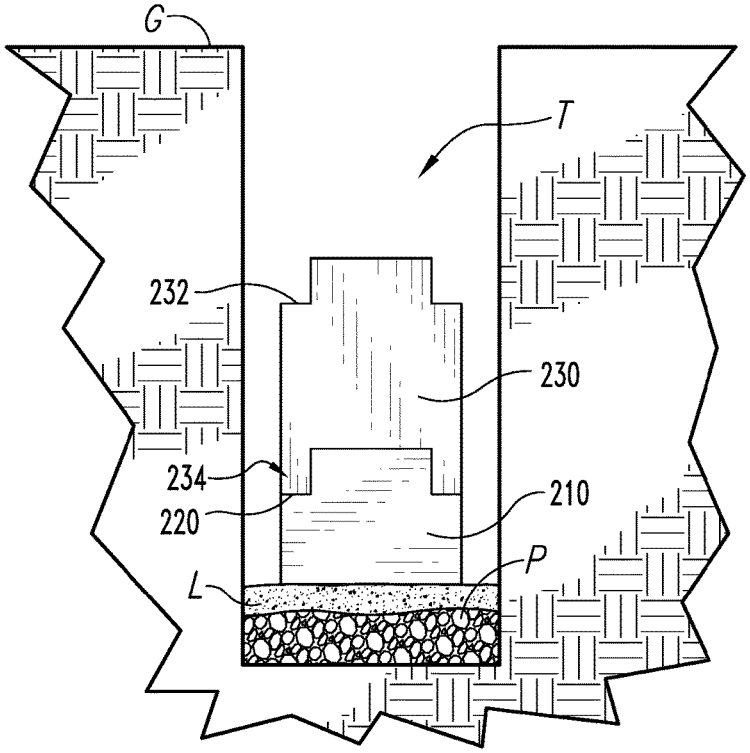
FIG. 3D is a front elevation view of the trench of FIG. 3A, with a precast wall piece of the second modular lift pit structure of FIG. 2 placed on-top of the precast base of the second modular lift pit structure.

As also shown in FIG. 3A, a layer of pea gravel P, such as a 8-12" layer, is spread at the bottom of trench T. Next, as shown in FIG. 3B, a self-leveling "lean" concrete L is poured to create a level surface on which to place precast slab 210. As shown in FIG. 3C, when the lean concrete L is sufficiently cured, precast slab 210 is lifted and placed into position by crane, hoist, or other means as will occur to those skilled in the art in view of the teachings herein. With precast slab 210 in place, precast wall piece 230 is then lifted and placed into position similar to that of precast slab 210. When placing precast wall piece 230 into position, mating feature 234 of precast wall piece and complementary mating feature 220 of precast slab 210 are laterally and longitudinally aligned such that mating features 220, 234 couple with each other.

Figure 3E:
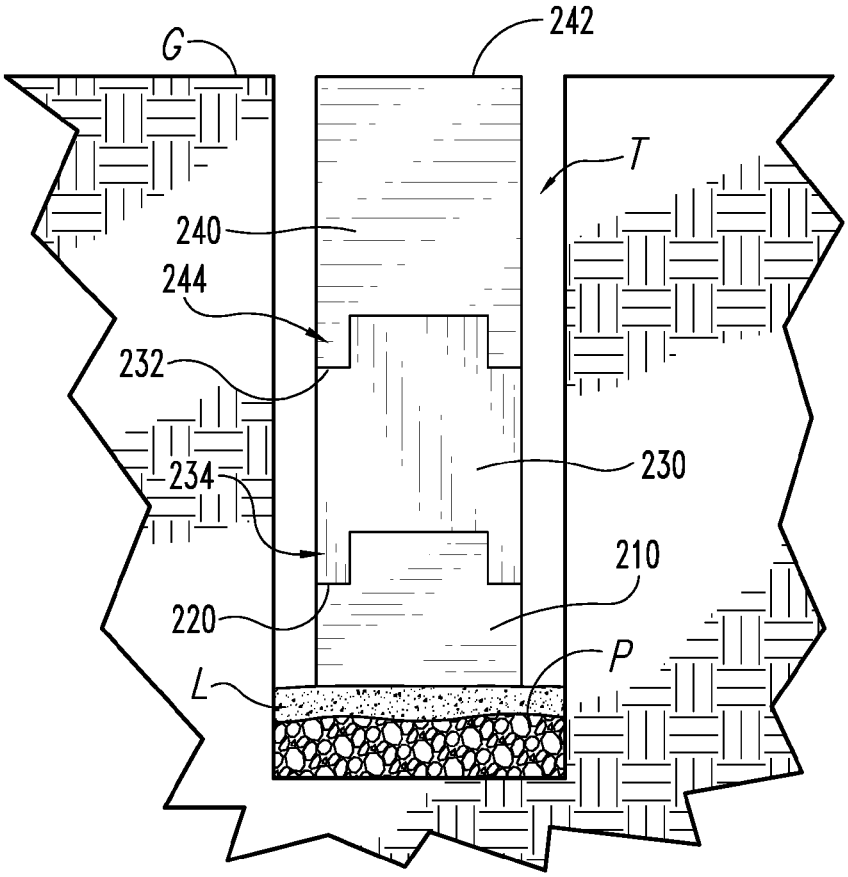
FIG. 3E is a front elevation view of the trench of FIG. 3A, with an upper precast wall of the second modular lift pit structure of FIG. 2 placed on-top of the precast wall piece of the second modular lift pit structure.

Next, as shown in FIG. 3E, upper precast wall 240 is lifted and placed into position similar to precast slab 210 and precast wall piece 230. Therefore, precast wall piece 230 and upper precast wall 240 couple with each other via complementary mating features 244, 232. It should be understood that any suitable number of precast wall pieces 230 may be used in between precast slab 210 and upper precast wall 240 to reach a desired height of pit structure 200. Alternatively, precast wall pieces 230 may be entirely omitted if upper precast wall 240 and precast slab provide a sufficient height for pit structure 200.

Figure 3F:
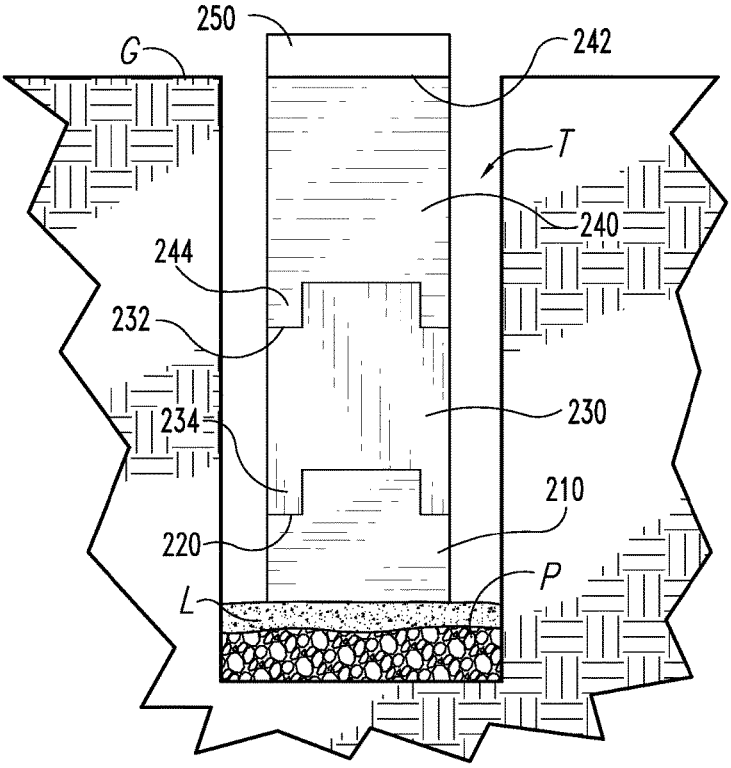
FIG. 3F is a front elevation view of the trench of FIG. 3A, with a mechanical assembly of the second modular lift pit structure of FIG. 2 placed on-top of the upper precast wall of the second modular lift pit structure.
Figure 3G:
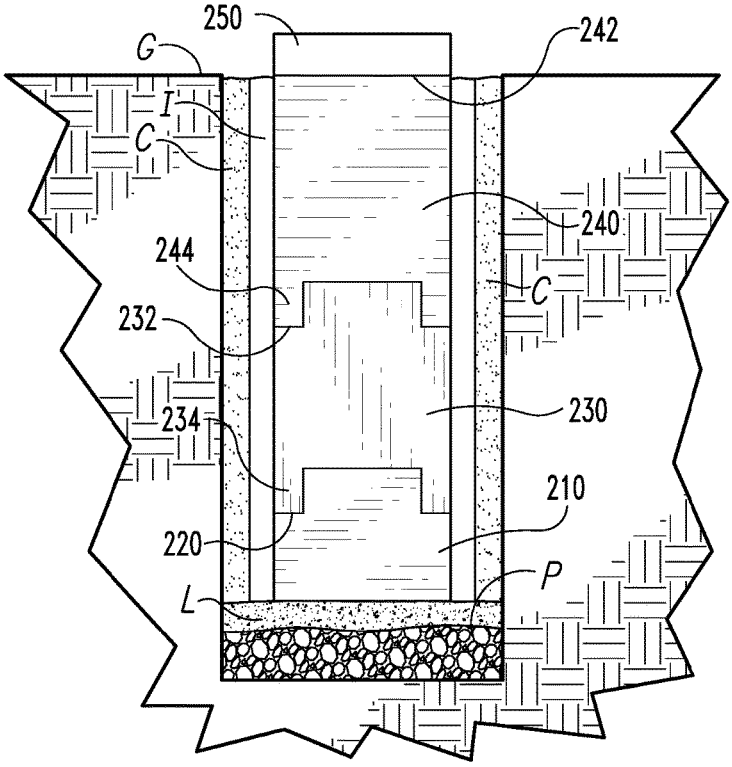
FIG. 3G is a front elevation view of the trench of FIG. 3A housing the assembled second modular lift pit structure of FIG. 2, wherein the trench is backfilled with crushed stone.

With upper precast wall 240 set in place, FIG. 3F shows mechanical assembly 250 fixed to top edge 242 of upper precast wall 240. Mechanical assembly 250 may be fixed to top edge 242 of upper precast wall 240 with any suitable coupling means known to one having ordinary skill in the art in view of the teachings herein. For example, a plurality of bolts may couple mechanical assembly 250 with top edge 242. With pit structure 200 assembled, a layer of insulation I (such as a two-inch layer of STYROFOAM) may be added to the exterior of pit structure 200 and crushed stone C or other material may be placed between the walls and the surrounding earth to backfill the slack space. Rebar may be added to surround the exterior of top edge 242, a slab floor of the surrounding structure is then formed and placed, and the lift is installed.

In some embodiments, one or more wall pieces 230, 240 are plumbed internally to allow for routing of electronic, hydraulic, water, or other service connections as desired.

Figure 4:
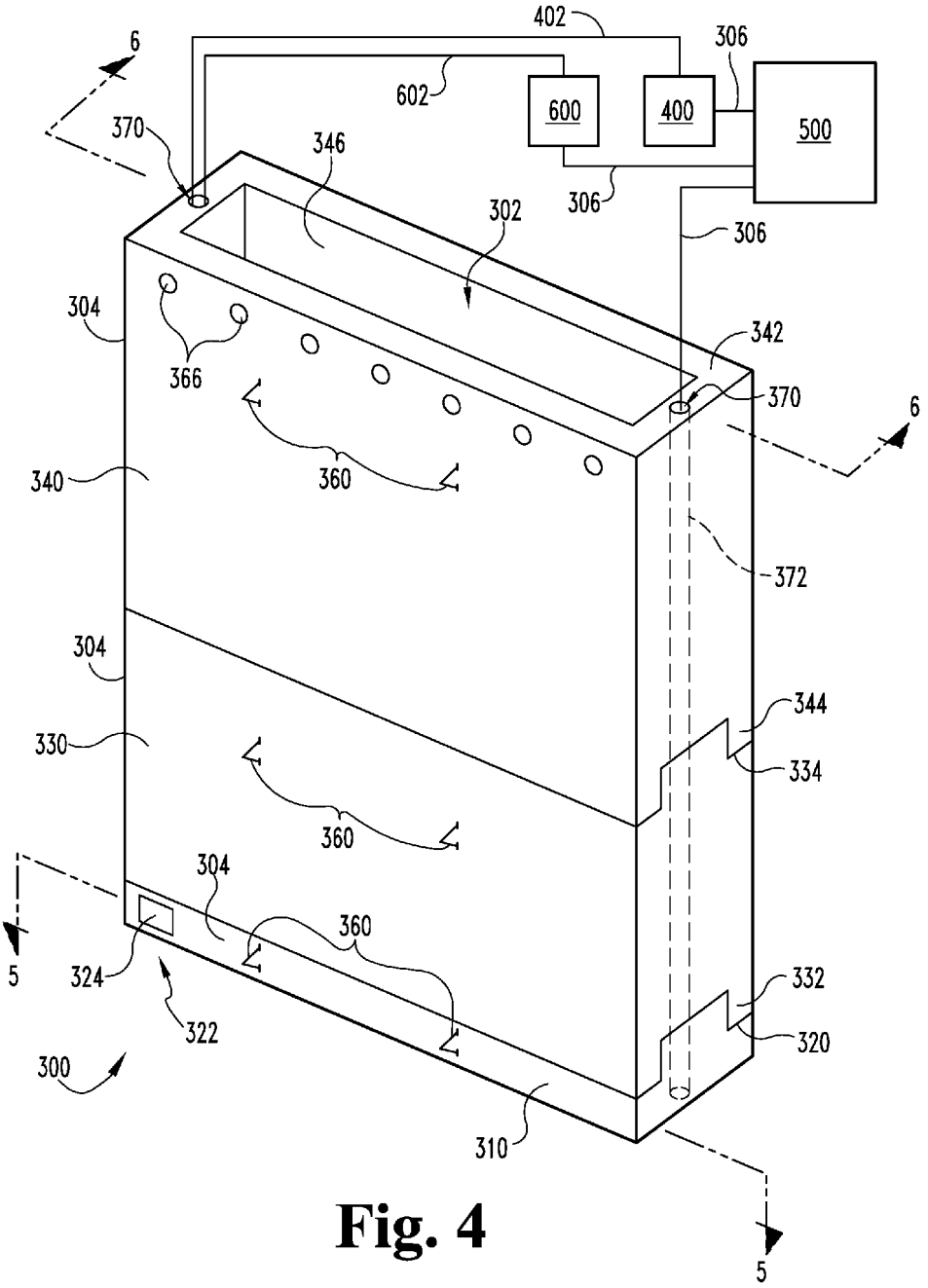
FIG. 4 is a perspective view of a third modular lift pit structure, a hydraulic pump assembly, and an electronic control assembly.

FIG. 4 shows another exemplary pit structure 300 that may be used in place of pit structures 100, 200 described above. Pit structure 300 includes a precast base 310, a precast wall piece 330, an upper precast wall 340, and a mechanical assembly 350; which are substantially similar to precast base 210, precast wall piece 230, upper precast wall 340, and mechanical assembly 250 described above, respectively, with differences described below. Therefore, precast pit 300 may be installed in substantially the same manner as precast pit 200 described above.

Precast base 310 includes a mating feature 320 substantially similar to mating feature 220 described above. Additionally, precast wall piece 330 includes a complementary mating feature 332 substantially similar to mating feature 232 described above. Mating feature 332 is located on a bottom portion of precast wall piece 330. Mating feature 332 is configured to couple with mating feature 320 of precast base 310 such that precast wall piece 330 may couple with precast base 310 when wall piece 330 is properly placed above base 310.

Precast wall piece 330 also includes a mating feature 334 substantially similar to mating feature 234 described above. Mating feature 334 is located on a top portion of precast wall 330. Upper precast wall 340 includes a complementary mating feature 344 substantially similar to mating feature 244 described above. Mating feature 344 is located on a bottom portion of upper precast wall 340. Mating feature 344 is configured to couple with mating feature 334 of precast wall piece 330 such that upper precast wall 340 may couple with precast wall piece 330 when upper precast wall 340 is properly placed above precast wall piece 330.

In the current example, mating features 320, 332, 334, 344 are formed with complementary tongue-and-groove relationships as described above. However, any suitable complementary mating features may be used as would be apparent to one having ordinary skill in the art in view of the teachings herein. For example, mating features 320, 332, 334, 344 may have a complementary sawtooth geometry, or a complementary dovetail geometry.

Upper precast wall 340 includes a top edge 342 substantially similar to top edge 342 described above. Therefore, mechanical assembly 350 (see FIG. 6) may couple with top edge 342 of upper precast wall 340 by any suitable means known to a person having ordinary skill in the art in view of the teachings herein. For example, mechanical assembly 350 may couple with top edge 342 via a plurality of bolts.

Figure 6:
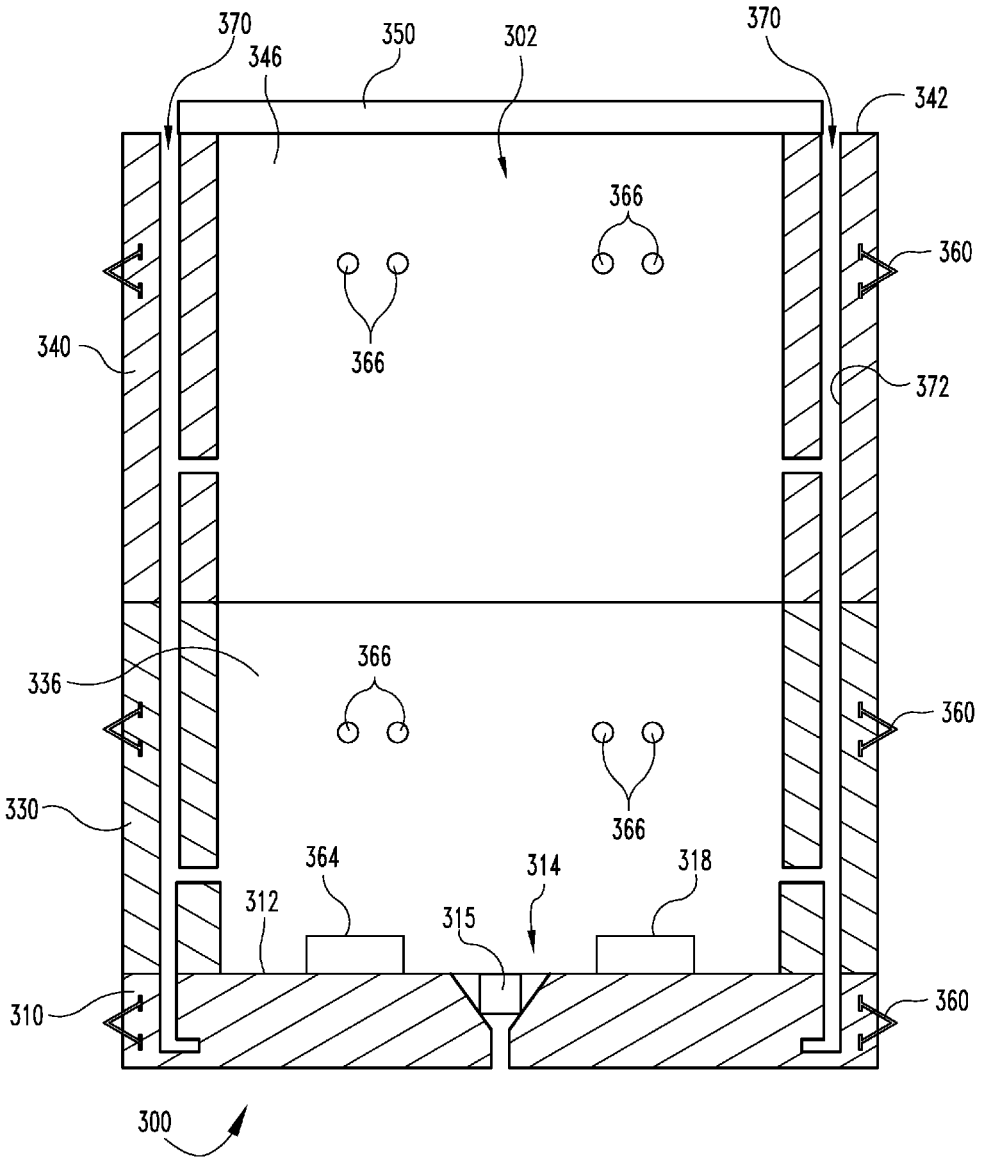
FIG. 6 is a side elevation view of the third modular lift pit structure of FIG. 4, taken along line 6-6 of FIG. 4.

As best seen in FIG. 6, hollow interior 302 is defined by interior wall 346 of upper precast wall 340, interior wall 336 of precast wall piece 330, and a top surface 312 of precast base 310. As will be described below, hollow interior 302 is dimensioned to house vehicle actuation assembly 700.

Upper precast wall 340, precast wall piece 330, and precast base 310 may each include a precast coating 304 (see FIG. 4) coated onto the surface of each wall 340, 330 and base 310. Precast coating 304 may include a coating designed for specific functions such as water proofing, chemical resistance, electrolysis resistance, any other suitable functions that would be apparent to one having ordinary skill in the art, or any combination of functions described above. Suitable precast coatings 304 include the XYPEX ADMIX C-series (available from XYPEX of Richmond, British Columbia, Canada), TNEME-LINER Series 61 cycloaliphatic amine epoxy (available from Tnemec Co., Inc. of Kansas City, Mo.), ConSeal series sealants and membranes (available from Concrete Sealants, Inc. of Tipp City, Ohio), and combinations thereof.

Upper precast wall 340, precast wall piece 330, and precast base 310 each include lifting features 360 unitarily formed in or attached to a respective surface. Lifting features 360 may be precast into the structures of upper precast wall 340, precast wall piece 330, and precast base 310. Alternatively, lifting features 360 may be unitarily coupled after the precast structures are formed. Lifting features 360 are sufficiently connected to upper precast wall 340, precast wall piece 330, and precast base 310 such that a hoist or crane may couple with lifting features 360 and lift the weight of respective base 310 or walls 330, 340. Therefore, the addition of lifting features 360 may provide an easy method of coupling base 310 or walls 340 with a hoist or crane for placement of base 310 and walls 340 into proper position within trench T. Lifting features 360 may in turn make proper placement of base 310 and walls 340 easier to accomplish. In the current example, lifting features 360 are made of lifting hooks (such as A-anchors available from Concrete Accessories of GA, Inc. of Duluth, Ga.) anchored into base 310 and walls 330, 340. However, brackets defining slots, cutouts for removable placement of support beams or straps, or any other suitable structure may be used as lifting features 360 as would be apparent to one having ordinary skill in the art in view of the teachings herein. In the current example, lifting features 360 are located on an exterior of base 310 and walls 330, 340. However, lifting features 360 may be placed in any suitable location for coupling with a hoist or crane as would be apparent to one having ordinary skill in the art in view of the teachings herein. For example, lifting features 360 may be located on interior walls 346, 336 of walls 340, 330.

Figure 5:
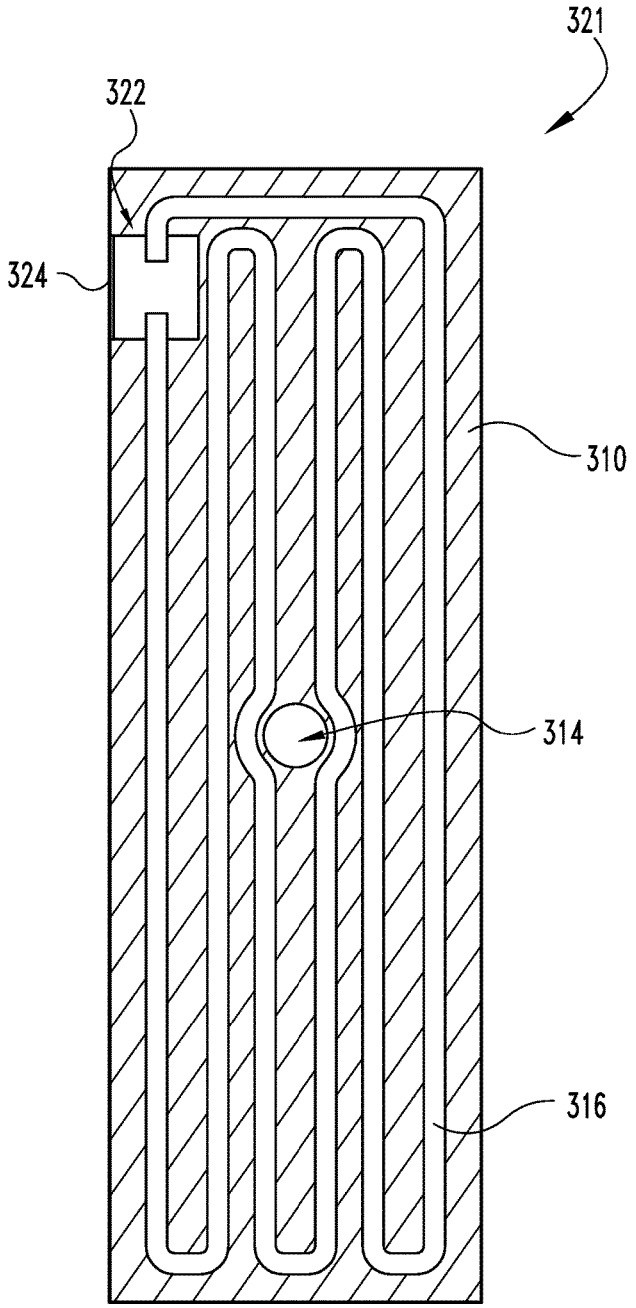
FIG. 5 is a top plan view of a precast base of the third modular lift pit structure of FIG. 4, taken along line 5-5 of FIG. 4.

As best seen in FIG. 5, precast base 310 may include an optional heating assembly 321. Heating assembly 321 may be configured to provide a heat source within pit structure 300 such that pit structure 300 may properly operate in colder climates. In the current example, heating assembly 321 is associated with precast base 310. However, it should be understood that heating assembly 321 may be additionally or alternatively installed in precast wall piece 330 or upper precast wall 340. Heating assembly 321 includes a heat distribution element 316 precast within the body of precast base 310. In the current example, heat distribution element 316 is a PEX tubing that passes through precast base 310 in a snake-like formation. However, any suitable heat distribution element 316 and geometry may be used as would be apparent to one having ordinary skill in the art in view of the teachings herein. For example, heat distribution element 316 may be electrical resistive wiring. Additionally, heat distribution element 316 may have a zig zag geometry. Heating assembly 321 also includes a junction box 324 that is also precast within the body of precast base 310. Junction box 324 includes an access opening 322 located on an exterior surface of precast base 310. Ends of heat distribution element 316 terminate within junction box 324. Therefore, during installation of pit structure 300, ends of heat distribution element 316 may be connected to a heat source external to pit structure 300. Alternatively, junction box 324 may be located such that access opening 322 may be located within hollow interior 302 or internal plumbing lines 370. Therefore, heat distribution element 316 may be connected to a heat source located within pit structure 300 or external to pit structure 300.

As best seen in FIGS. 4 and 6, upper precast wall 340 and precast wall piece 330 include a plurality of mounting members 366, while top surface 312 of precast base 310 includes another mounting structure 364. In the current example, mounting structures 366 include threaded inserts (such as zinc alloy or plastic threaded inserts available from A. L. Patterson, Inc. of Fairless Hills, Pa.) precast within walls 330, 340. However, any other suitable mounting structure 366 may be utilized as would be apparent to one having ordinary skill in the art, such as brackets. Additionally, mounting structures 366 may also be unitarily coupled with walls 330, 340 after structures are cast.

As best seen in FIG. 4, upper precast wall 340 includes a plurality of mounting members 366 located around an exterior perimeter of upper precast wall 340 adjacent to top edge 342. These mounting members 366 may be coupled with rebar after upper precast wall 340 is coupled with precast wall piece 330. Rebar may mate with a freshly poured slab floor such that the slab floor solidifies around the rebar. Therefore, mounting members 366 may help further enhance the structural integrity of pit structure 300 by coupling with rebar.

As best seen in FIG. 6, interior walls 346, 336 of upper precast wall 340 and precast wall piece 330 also include a plurality of mounting members 366. Mounting members 366 located within interior walls 346, 336 may be used to couple various components of vehicle lift assembly 700 with pit structure 300 once vehicle lift assembly 700 is installed. Mounting member 364 may also be used to couple various components of vehicle lift assembly 700 with pit structure 300 once vehicle lift assembly 700 is installed. Mounting member 364 may be substantially similar to mounting members 366 described above. While in the current example, there is only one mounting member 364 associated with precast base 310, any suitable number of mounting members 364 may be associated with precast base 310 as would be apparent to one having ordinary skill in the art in view of the teachings herein.

FIG. 6 shows a precast base 310 defining a drain cutout 314. Top surface 312 of precast base 310 may be sloped toward drain cutout 314 such that any accumulated fluids within pit structure 300 drains toward drain cutout 314. Drain cutout 314 also houses a drain box 315, which leads to an external portion of precast base 310. Drain box 315 may be in fluid communication with external fluid management devices within trench T designed to lead excess fluid away from trench T and pit structure 300.

As also shown in FIG. 6, pit structure 300 includes a seismic sensor 318 encased within base 310. In various embodiments, seismic sensor 318 may be of a fiber-optic variety, the electronic varieties produced by Resensys (of College Park, Md.; e.g., Senspot, Senimax or Senscope), or of another type as will occur to those skilled in the art. Seismic sensor 318 may be configured to detect seismic shifts occurring nearby in order to properly warn an operator that the structural integrity of pit structure 300 may be compromised. Seismic sensor 318 may be battery powered or powered through electrical wiring 306. Additionally, seismic sensor 318 may be in communication with any suitable device required to warn an operator of potential seismic shifts, such as a control panel or a speaker/lights located near pit structure 300. In the current example, seismic sensor 318 is located directly on/within precast base 310. However, seismic sensor 318 may be located at any other suitable location within or adjacent to pit structure 300 as would be apparent to one having ordinary skill in the art. For example, seismic sensor 318 may be located within walls 330, 340, within junction box 322, within a separate junction box fixed to base 310 or walls 330, 340, or within trench T.

As can be seen in FIGS. 4 and 6, upper precast wall 340, precast wall piece 330, and precast base 310 define two internal plumbing lines extending from top edge 342 of upper precast wall 340 all the way to precast base 310. Internal plumbing lines 370 may provide safe access for electrical wiring or fluid communication between an exterior of pit structure 300 and a hollow interior 302 of pit structure 300. In this illustrated embodiment, each internal plumbing line 370 is defined within upper precast wall 340, precast wall piece 330, and precast base 310 such that each internal plumbing line 370 is continuous when concrete pit 300 is correctly assembled.

While two internal plumbing lines 370 are used in the current example, any suitable number of internal plumbing lines 370 may be incorporated into pit structure 300 as will be apparent to one having ordinary skill in the art in view of the teachings herein. Additionally, in the current example, internal plumbing lines 370 extend all the way from top edge 342 to precast base 310, but this is merely optional. Internal plumbing lines 370 may extend any suitable length from at or near top edge 342 as would be apparent to one having ordinary skill in the art in view of the teachings herein. For example, internal plumbing lines 370 may terminate within upper precast wall 340 of precast wall piece 330. Internal plumbing lines 370 may be lined with an electrical chase member 372 to help further insulate electrical wiring.

As best seen in FIG. 4, internal plumbing lines 370 may receive electrical wiring 306, hydraulic lines 402, and an air line 602. In the current example, a control system 500 is connected to electrical wiring 306 extending into internal plumbing line 370 housing an electrical chase member 372. As will be described in greater detail below, electrical wiring 306 extending into internal plumbing line 370 may connect with selected components of a vehicle lift system 700 for electrical communication with various aspects of vehicle lift system 700. Control system 500 is also in electrical communication with hydraulic pump assembly 400 and air compressor assembly 600 via electrical wires 306. Control system 500 may include various suitable user input components allowing a user to selectively activate hydraulic pump assembly 400 and air compressor assembly 600.

Hydraulic pump assembly 400 is connected to a hydraulic line 402 which extends into internal plumbing line 370. As will be described in greater detail below, hydraulic line 402 may connect hydraulic pump assembly 400 with various components of vehicle lift system 700 in order to actuate vehicle lift system 700 within pit structure 300. Hydraulic pump assembly 400 may be activated and deactivated by commands sent from control system 500 via electrical wiring 306. Hydraulic pump assembly 400 may include any number of suitable components required to actuate a vehicle lift system 700 as would be apparent to one having ordinary skill in the art in view of the teachings herein.

Air compressor assembly 600 is connected to an air line 602, which also extends into internal plumbing line 370. Air line 602 may connect to various components of vehicle lift assembly 700 in order to selectively activate and deactivate any suitable type of safety locking mechanism of vehicle lift assembly 700. Air compressor assembly 600 may be activated and deactivated by commands sent from control system 500 via electrical wiring 306.

Figure 7A:
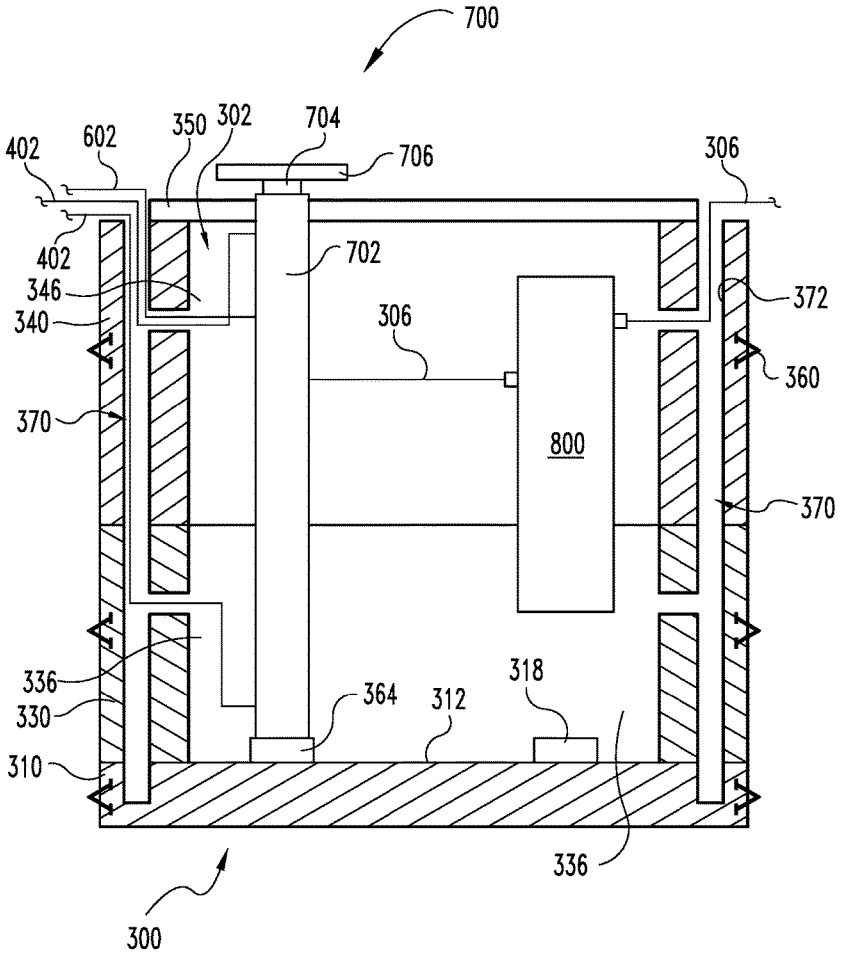
FIG. 7A is a side elevation view of the third modular lift pit structure of FIG. 4 housing a vehicle lift assembly, wherein the vehicle lift assembly is in a lowered position.
Figure 7B:
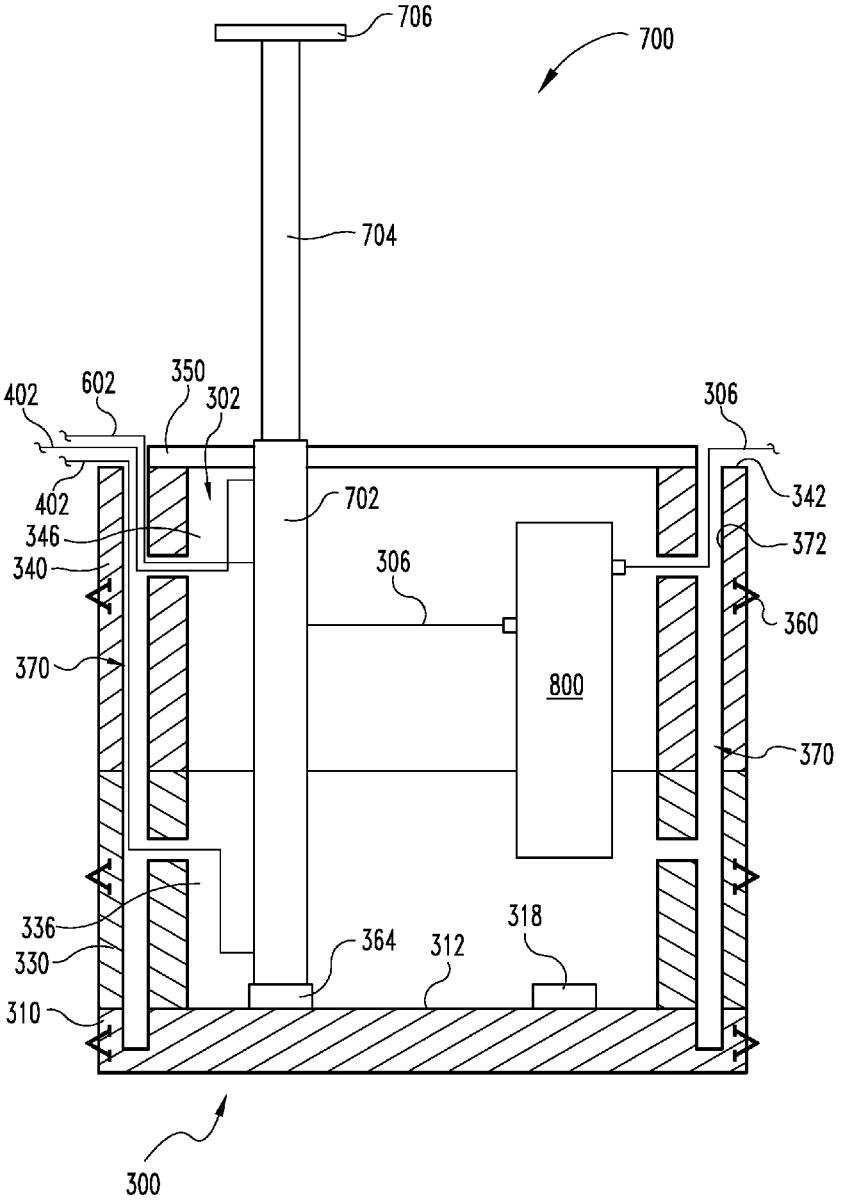
FIG. 7B is a side elevation view of the third modular lift pit structure of FIG. 4 housing the vehicle lift assembly of FIG. 7A, wherein the vehicle lift assembly is in a raised position.

FIGS. 7A-7B show a vehicle lift assembly 700 installed within pit structure 300. Vehicle lift assembly 700 includes a hydraulic cylinder 702, a rod 704 slidably housed within hydraulic cylinder 702, a vehicle engagement member 706 attached to a portion of rod 704 located furthest from hydraulic cylinder 702, and a low voltage electrical box 790. In the current example, hydraulic cylinder 702 and low voltage electrical box 790 are fixed to pit structure 300 via mounting members 366, 364. Hydraulic cylinder 702 and low voltage electrical box 790 are fixed to mounting member 366, 364 via any suitable fixing apparatus, such as threaded bolts. In the current example, hydraulic cylinder 702 is stationary relative to the rest of pit structure 300. However, it is envisioned that hydraulic cylinder 702 may be attached to pit structure 300 via mechanical assembly 350 such that hydraulic cylinder 702 may translate along the length of pit structure 300 as described, for example, in US Published Application No. 2014/0264203, entitled "Handheld Control Unit for Automotive Lift," published Sep. 18, 2014, which is incorporated by reference herein.

Low-voltage electrical box 790 is connected to electrical wiring 306 extending within electrical chase member 372 and internal plumbing line 370. While not directly shown in FIGS. 7A-7B, it should be understood that electrical wiring 306 extending within electrical chase member 372 and internal plumbing line 370 is also connected to control system 500, as shown in FIG. 4. Low voltage electrical box 790 is also in electrical communication with various other components of vehicle lift assembly 700 via electrical wiring 306, such as various sensors or any other suitable components as would be apparent to one having ordinary skill in the art in view of the teachings herein. Therefore, low voltage electrical box 790 may communicate data to control system 500, such as rod height. Control system 500 may further display this information or use such information to automatically activate hydraulic pump assembly 400 or air compressor assembly 600.

Hydraulic cylinder 702 is connected with two hydraulic lines 402 on opposite ends of cylinder 702. Hydraulic lines 402 run through internal plumbing line 370. It should be understood that hydraulic lines 402 are also connected to hydraulic pump assembly 400. Therefore, an operator may activate hydraulic pump assembly 400 via control system 500 in order to pump hydraulic fluid within hydraulic cylinder 702, thereby raising or lowering rod 704 and vehicle engagement member 706 relative to pit structure 300 and hydraulic cylinder 702 (as shown between FIGS. 7A-7B).

Vehicle lift system 700 is also connected to an air line 602. Air line 602 runs through internal plumbing line 370. It should be understood that air line 602 is also connected to air compressor assembly 600. Therefore, control system 500 may activate air compressor assembly 600 to send compressed air to vehicle lift system 700 via air line 602. This may selectively activate/deactivate any mechanical locking mechanism designed to prevent inadvertent lowering of rod 704 relative to hydraulic cylinder 702, or it may achieve other goals as will occur to one having ordinary skill in the art in view of the teachings herein. Any suitable locking system may be used as would be apparent to one having ordinary skill in the art in view of the teachings herein.

Figure 8:
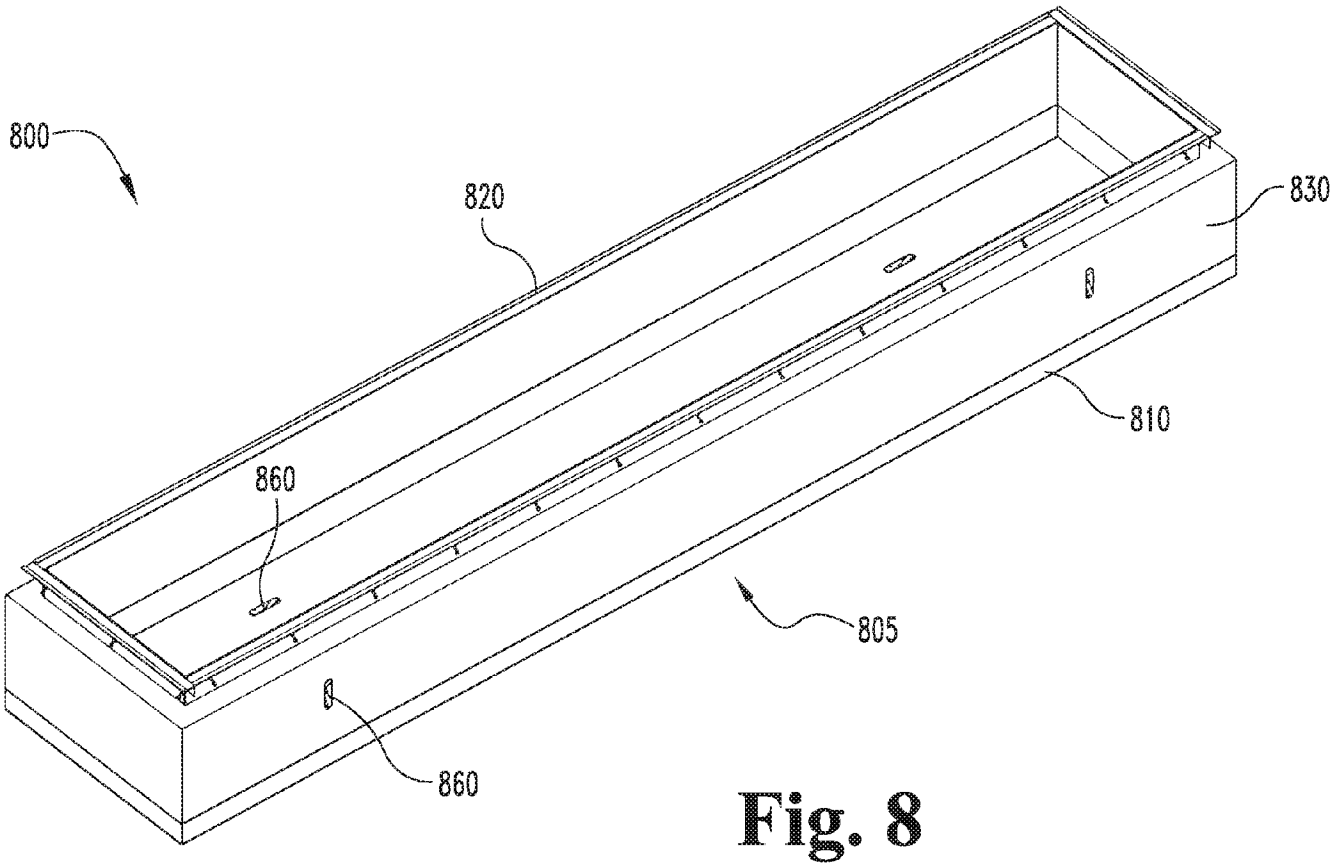
FIG. 8 is a perspective view of a fourth modular lift pit structure.

FIG. 8 shows yet another exemplary pit structure 800, which incorporates an integrated base and wall module 805, which comprises base portion 810 and wall portion 830 as a single, precast unit. In some embodiments, this integrated module 805 is slightly more challenging to place in a trench T, but saves the design and implementation challenges of fitting a bottom wall segment to a base segment and avoids potential leaks in the seam between the two. Connection features 820 in some implementations facilitate mating of the top of integrated module 805 with the bottom of upper wall pieces, such as upper precast wall piece 240 (see FIG. 2). In other implementations, no additional wall pieces 240 are needed, and optional connection features 820 facilitate integration with the top of the trench T and surrounding structures, such as the floor of a building. Lifting features 860 are integrated and used like lifting features 360 described above in relation to FIGS. 4 and 6. The other structures, channels, and attachment features discussed above in relation to FIGS. 1-7B may also be used in and with pit structure 800 as will occur to those skilled in the art in view of the present disclosure.

Figure 9:
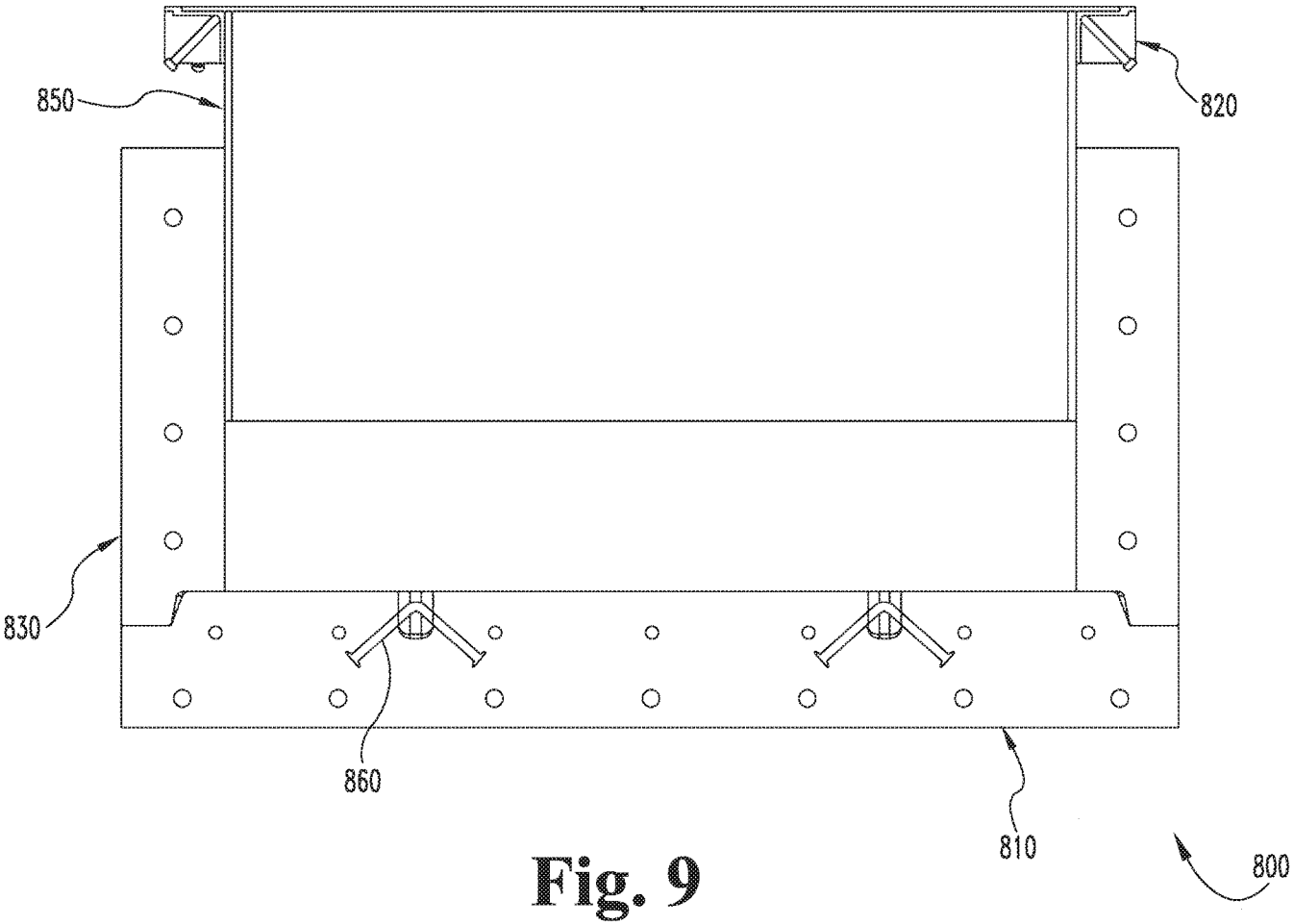
FIG. 9 is a horizontal section view of the fourth modular lift pit structure.

FIG. 9 shows a cutaway view of exemplary pit structure 800. Base portion 810 supports the rest of structure 800 and is integrated as a single, precast unit with wall portion 830. Like lifting features 360 discussed above in relation to FIGS. 4 and 6, lifting features 860 are cast into base portion 810 and can be used by a crane or other lifting equipment to lift and place integrated module 805 into the trench T. Connection features 820 on liner/riser 850 illustrated in FIG. 9 are aligned with floor level to integrate with the surrounding structure. In alternative embodiments, features along the top of wall portion 830 are adapted for connection with additional wall pieces (such as wall piece 130 as illustrated in FIG. 1) to the pit structure can be built in segments according to this disclosure as will occur to those skilled in the art.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should also be understood that the teachings herein may be readily applied to various kinds of lifts. By way of example only, the teachings herein may be readily applied to platform lifts, material lifts, man lifts, etc. The teachings herein may also be readily applied to robotic leg assemblies, adjustable work stations, and shock absorber systems. Various suitable ways in which the teachings herein may be incorporated into such systems and assemblies will be apparent to those of ordinary skill in the art. Similarly, various other kinds of systems and assemblies in which the teachings herein may be incorporated will be apparent to those of ordinary skill in the art.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A vehicle lift assembly at least partially installed below ground, wherein the vehicle lift assembly comprises:

(i) a precast vault assembly configured to be placed at least partially into a trench, wherein the precast vault assembly comprises:

(a) a precast base configured to be placed within a bottom portion of the trench, and (b) at least one precast wall that extends above the precast base within the trench, wherein the at least one precast wall comprises an upper portion and an interior wall, wherein the interior wall of the precast wall defines a hollow interior, (c) a mounting feature fixed within at least one of the precast base and the at least one precast wall; and (ii) a vehicle lift assembly comprising:

(a) a lift frame configured to be fixed relative to the upper portion of the at least one precast wall of the precast vault assembly, and (b) an actuation member in operable contact with the lift frame such that the at least one precast wall at least partially supports the actuation member via the lift frame, wherein the actuation member is configured to lift a vehicle from a lowered position to a raised position relative to the lift frame.

2. The vehicle lift assembly of claim 1, wherein the mounting feature is located on an exterior of the at least one precast wall.

3. The vehicle lift assembly of claim 2, wherein the mounting feature:

is located adjacent to a top edge of the at least one precast wall, and the mounting feature is configured to receive a piece of rebar.

4. The vehicle lift assembly of claim 1, wherein the mounting feature is precast on the at least one interior wall.

5. The vehicle lift assembly of claim 1, wherein the mounting feature comprises a threaded insert.

6. The vehicle lift assembly of claim 1, wherein the vehicle lift assembly further comprises a heating assembly precast into the precast vault.

7. The vehicle lift assembly of claim 6, wherein:

the heating assembly comprises a junction box and a fluid distribution element;

the fluid distribution element comprises a first end and a second end; and the first end and the second end are located within the junction box.

8. The vehicle lift assembly of claim 7, wherein:

the heating assembly is precast into the precast base, and the junction box further comprises an access opening located on a surface of the precast base.

9. The vehicle lift assembly of claim 1, wherein the at least one precast wall defines an internal plumbing line.

10. The vehicle lift assembly of claim 9, wherein:

the actuation member is hydraulically coupled to a pump via a hydraulic hose; and the hydraulic hose runs through the internal plumbing line.

11. The vehicle lift assembly of claim 1, wherein:

the precast base has a top surface that partially defines the hollow interior, the precast base defines a drain cutout, the drain cutout provides fluid communication from the hollow interior to an exterior of the precast vault, and the top surface slopes toward the drain cutout.

12. The vehicle lift assembly of claim 1, further comprising a seismic sensor integrated with the precast vault.

13. The vehicle lift assembly of claim 1, further comprising a plurality of lifting features fixed to the at least one precast wall.

14. The vehicle lift assembly of claim 13, wherein the plurality of lifting features are fixed to an external surface of the at least one precast wall.

15. The vehicle lift assembly of claim 13, wherein the plurality of lifting features are fixed to the internal surface of the at least one precast wall.

16. The vehicle lift assembly of claim 1, further comprising a precast coating on the outside of the precast vault assembly.

* * * * *